United States Patent [19]

Evans

[11] Patent Number: 4,741,490

[45] Date of Patent: May 3, 1988

[54] MANDREL FOR APPLYING WRAPPING MATERIAL

[75] Inventor: John R. Evans, Slough, England

[73] Assignee: W. R. Grace Ltd., London, England

[21] Appl. No.: 106,950

[22] Filed: Oct. 14, 1987

Related U.S. Application Data

[63] Continuation of Ser. No. 883,200, Jul. 8, 1986, abandoned.

[30] Foreign Application Priority Data

Jul. 26, 1985 [GB] United Kingdom ..... 8518946

[51] Int. Cl.[4] ..... B65H 75/40; B65H 23/06; B65B 11/00; B65B 45/00

[52] U.S. Cl. ..... 242/96; 53/219; 53/390; 53/588; 156/392; 242/94; 242/99

[58] Field of Search ..... 242/96, 99, 94, 75.45, 242/75.47; 156/392, 391; 53/390, 588, 219

[56] References Cited

U.S. PATENT DOCUMENTS

| | | | |
|---|---|---|---|
| 1,849,383 | 3/1932 | Richardson . | |
| 3,030,047 | 4/1962 | Anderson | 242/94 |
| 4,008,114 | 2/1977 | Lindsey | 242/75.45 X |
| 4,069,088 | 1/1978 | Cottam | 156/392 |
| 4,095,395 | 6/1978 | Goldstein | 53/210 X |
| 4,176,805 | 12/1979 | Jackson | 242/75 |
| 4,248,392 | 2/1981 | Parry | 242/96 |
| 4,477,037 | 10/1984 | Goldstein | 242/99 X |

FOREIGN PATENT DOCUMENTS

| | | | |
|---|---|---|---|
| 318022 | 7/1969 | Sweden | 242/94 |
| 322991 | 8/1930 | United Kingdom . | |
| 347362 | 4/1931 | United Kingdom . | |
| 700676 | 3/1950 | United Kingdom . | |
| 681013 | 10/1952 | United Kingdom . | |
| 816881 | 8/1956 | United Kingdom . | |
| 1063861 | 6/1964 | United Kingdom . | |
| 1073269 | 11/1965 | United Kingdom . | |
| 1172520 | 12/1966 | United Kingdom . | |
| 1395008 | 5/1971 | United Kingdom . | |
| 1507506 | 6/1974 | United Kingdom . | |
| 2065070 | 6/1981 | United Kingdom | 242/96 |

*Primary Examiner*—Stuart S. Levy
*Assistant Examiner*—Thomas R. Hannon
*Attorney, Agent, or Firm*—Bart G. Newland; William L. Baker

[57] ABSTRACT

A mandrel for use in winding a web around an article, the mandrel including a support for a roll of the web, a handle rotatably attached at each end of the support and a brake which retards rotation of the support relative to at least one handle by an amount depending on the relative rotation between the handle and support which has already taken place.

10 Claims, 1 Drawing Sheet

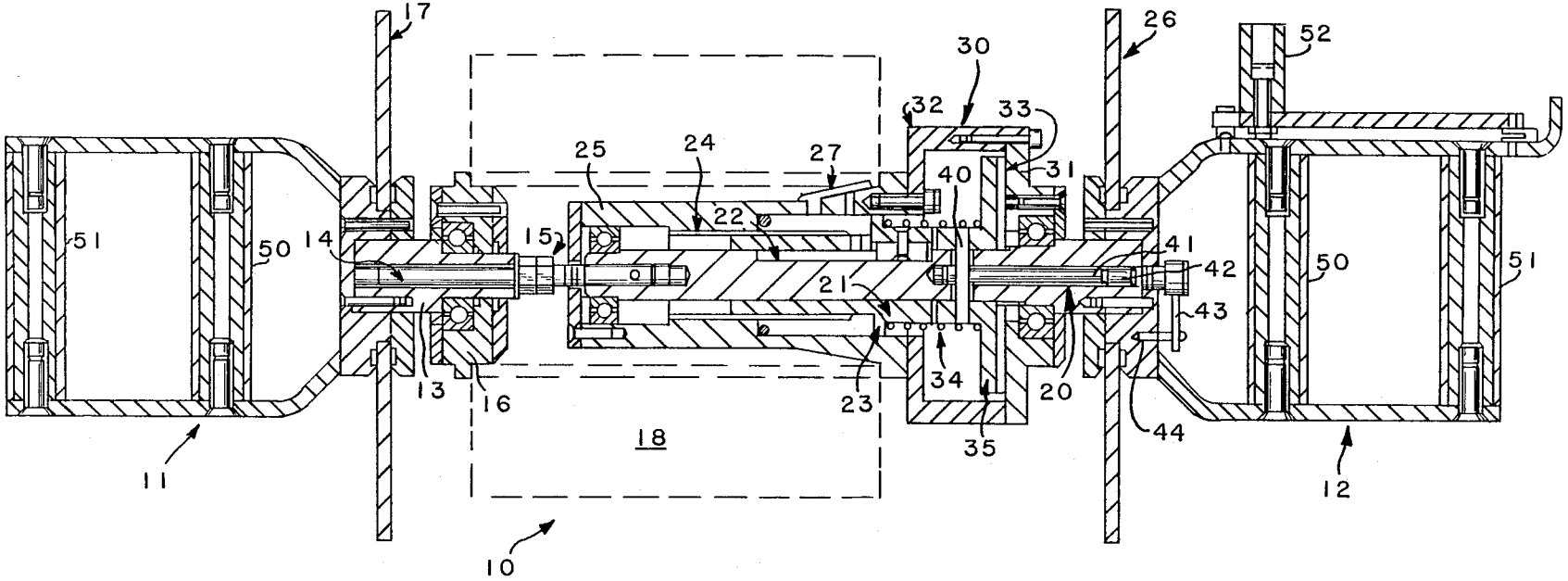
51
52
50
12
26
42
41
43
44
20
31
33
30
32
40
34
35
21
23
27
22
24
25
18
15
16
10
17
13
14
50
11
51

MANDREL FOR APPLYING WRAPPING MATERIAL

This is a continuation of co-pending application Ser. No. 883,200 filed on July 8, 1986 now abandoned.

This invention relates to a mandrel for applying wrapping material.

There are many instances where a wrapping material needs to be applied spirally or helically around an object. One example is the application of protective coverings to pipelines. For instance, self-adhesive wrapping materials comprising a plastics support sheet with a self-adhesive bituminous composition on one side thereof are often applied to pipelines from, for instance, six to sixty inches in diameter before these are buried under ground.

It is desirable with such materials that they be wrapped round the pipeline with a constant and supervised tension. Otherwise, the protective effect may be jeopardized. Clearly, this situation is rather difficult to achieve when web material is applied manually on a pipe from a roll because in that situation reliance is placed on the skill of the operator or operators. Usually the roll has to be passed from side to side of the pipe and there is an operator on each side. The same point arises when a web is applied by machine. This can be done with the roll rotating about and moving along the pipe using, for instance, a wheeled cradle contacting the outside of the pipe, rotating therearound and carrying the roll. A web can also be mechanically applied by supporting it adjacent a pipe which is then rotated while relative movement in the axial direction, usually with the roll of web moving, is brought about.

An aim of the invention is to provide a mandrel which allows the application of a web of material to an article at a generally constant tension.

According to the present invention, there is provided a mandrel for use in winding a web around an article, the mandrel including a support for a roll of the web, a holding means rotatably attached at one end of the support, freely rotable wheels at each side of the support to extend radially outwardly beyond a roll when located on the support, brake means which retards rotation of the support relative to said holding means by an amount depending on the relative rotation between the holding means and support which has already taken place, and means to disengage the brake and reset the brake means when a new roll is applied.

In embodiments for manual operation there is preferably a handle at each end of the support, one handle constituting said holding means. In embodiments for mechanical operation the holding means allows holding, clamping, or some other form of retention of the mandrel on the mechanical apparatus whether it is of the type which rotates around a pipe or is used with a pipe which itself rotates.

If material is already applied from a roll to an article such as a pipe, and an operator, or a device, holding the roll pulls upon it without holding it firmly against rotation, the tension in the distance between the pipe and the roll will depend upon the diameter of the remaining part of the roll. If, as tends to happen, operators apply an entire roll in this way then the outer or first portions of the web will not be tensioned so greatly upon application to the pipe as the later or inner portions. The apparatus of the invention allows a braking effect to be applied which takes account of the diminishing diameter of the roll. The braking effect is reduced as the roll is unwound so that a generally constant tension is imparted to the web as it is applied to the article. Means can be provided whereby when a new roll is put on the mandrel the brake is tightened up again, so that the greater braking effect is available at the outset of application of the new roll.

Preferably the brake means includes a brake pad with a member urged against the pad with a force depending upon previous rotation between the mandrel and loading means, the pad and member being attached to rotate with respective ones of the mandrel and holding means. Preferably, the member is urged against the pad by a spring and preferably the spring contacts a moveable abutment, the position of which is controlled by the past rotation between the mandrel and holding means. Preferably, this is brought about by means of a screw threaded engagement between one member which rotates with the holding means and one which rotates with a roll on the mandrel. It will be appeciated that when each roll is exhausted it must be replaced with another and the braking operation needs to be restarted. To this end the brake can preferably be entirely disengaged for the purpose of resetting, for instance in the case of a screw-threaded engagement between two members as mentioned above, a process of turning the holding means relative to the mandrel will reset the moveable abutment to its initial position.

In order that the invention may be more clearly understood, the following description is given by way of example only, with reference to the accompanying drawing, in which the sole FIGURE is a longitudinal section of one form of apparatus according to the invention.

The apparatus of the invention is particularly illustrated in an embodiment for manual use, with a handle at each end. Such embodiment is readily adaptable by replacing one or both handles with one or two alternative holding means adapted for mechanical engagement. In what follows the term "handle" is to be understood to embrace such alternative holding means. As shown the apparatus includes a mandrel generally designated at 10 with a freely rotatable handle 11 at one end and another independently rotatable handle 12 at the other. The mandrel comes apart in the middle. Attached to the handle 11 is a sleeve 13 with a pin 14 extending therefrom to an adjustable extent and securable by nuts 15. Mounted by means of ball bearings on the sleeve 13 is a hub 16 for supporting one end of a roll. Freely rotatable on the inner end of the handle adjacent sleeve 13 is a wheel 17 which is designed to have a larger diameter than the roll. It is provided with a slightly rounded periphery. Thus, when the wheel contacts the surface of an article being covered the roll is kept apart from the surface. The pin 14 is detachably receivable in a socket in the other part of the mandrel. Thus the mandrel can simply be pulled apart when a roll of material to be applied needs to be put upon it. Such a roll is shown at 18 in dashed lines.

A rod 20 is attached to the handle 12. There is a bore at the end of the rod remote from the handle 12 into which the pin 14 is releasably fixed. Surrounding the rod 20 is an abutment sleeve 21 which is keyed to the rod 20 at 22 so as to rotate therewith but is slidable axially along the rod 20. This abutment sleeve 21 has an abutment 23 to be described below. The sleeve is threaded at 24, externally, and is engaged with an internal thread on a mandrel part 25 which is journaled with races at each end onto the rod 20. A wheel 26 is freely rotatable at the inner end of the handle 12 and is exactly the same as the wheel 17 in size and effect. Shims 27 are spaced apart around the mandrel part 25 to contact and engage the interior of a roll 18 and to ensure that the roll does not rotate relative to the part 25. Constituting part of the mandrel part 25 is a brake housing generally indicated at 30 which is inboard of the wheel 26 and outboard of the end of a roll 18 and comprises an end plate 31, which is the part of the mandrel part 25 journaled at the outboard end of the rod 20, and an enveloping annular member 32. The parts 31 and 32 together define the brake housing and inside the housing is located a brake pad 33 fixed to the plate 31. Spring urged against the pad 33 by the spring 34 is a brake disc 35. The effect of the spring 34 will, of course, depend upon the position of the abutment 23 and it can thus be seen that the effect of the brake will depend upon the position of the sleeve 21 relative to the mandrel part 25. Extending transversely through the rod 20 is a pin 40 which extends outwards beyond the rod 20 to engage in bores in a collar of the brake disc 35, so that the disc 35 rotates with the rod 20 and handle 12. Contacting the pin 40 is a push rod 41, which abuts a member 42 having thereon a transverse handle 43, and which is screw threaded into the end of the rod 20. When the handle and member 42 are rotated the pin 40 is moved to the left as shown, causing the brake disc 35 to move the left as shown and thus release the brake.

It will be seen that each of the handles 11 and 12 has a yoke with two grips 50 and 51 extending between the arms of the yoke. This is so that one operator can conveniently pass the device to another. The handle 12 carries a hingedly mounted knob 52 which is designed to be moved in use to a position allowing rapid rotation of that handle.

As mentioned above, when a fresh roll 18 is employed a greater braking effect is required than when the roll nears its end. Taking this into account, the braking force between the handle 12 and the mandrel should be at its greatest when the fresh roll is applied and this is achieved by applying the brake disc 35, which is fast with the handle 12, most severely against the brake pad 33, which is fast with the mandrel 25. Accordingly, when a new roll is supplied the abutment 23 needs to be to the right as shown, which is to say that the screw threaded engagement 24 between sleeve 21 and mandrel 25 needs to be such that the sleeve is to the right as shown. Assuming normal threads, this can be achieved by holding the mandrel 25 steady and by rotating handle 12 in the anti-clockwise sense. The actual number of turns needed will depend upon the size of the roll and the initial relative positions of the parts 21 and 25 but this will merely be a matter of practice.

As the roll is unwound the mandrel 25 rotates relative to the handle 12. The rotation will clearly have to be in the other sense, that is to say the mandrel must be rotated such that, viewed towards the handle 12, the mandrel rotates clockwise. This causes the screw thread 24 to operate in such a way as to move the sleeve 21 to the left as shown, this decreasing the load applied by the spring 34 and thus decreasing the braking effect. Selection of the thread pitch in the screw thread 24 coupled with consideration of the thickness of the material being unwound and the length of material being unwound and the spring strength can be such as to bring about a generally constant braking effect. When the roll is fully unwound, handle 43 is turned. This pushes brake disc 35 away from the brake pad and allows the resetting of the spring to take place. Shown at 44 is a stop for the handle 43.

The wheels 17 and 26 are designed to allow the apparatus to be rolled around a pipe or other article being covered. They engage felt seals on each side, and where possible the apparatus is sealed against ingress of dirt or material such as sand. The wheels thus make operation much more convenient and precise, and being of rounded rim structure do not dig into pipe surfaces. The device can be made in any size appropriate to the material being provided. Typically, materials for wrapping around pipelines are six inches (15 cm) wide. They generally contain 12 metres of material.

I claim:

1. A mandrel for use in winding a web around an article, the mandrel comprising a support for a roll of the web, a holding means rotatably attached at one end of the support, freely rotatable wheels at each side of the support and extending radially outwardly beyond a roll of the web on the support, a brake means which retards rotation of the support relative to said holding means by an amount depending on the relative rotation between the holding means and support which has already taken place, and means to disengage and reset the brake means when a new roll is applied.

2. A mandrel according to claim 1 wherein the brake means comprises a brake pad, a brake member, and means to urge said brake member against said brake pad with a force depending upon past rotation between the mandrel and holding means.

3. A mandrel according to claim 2 wherein the brake member is a disc.

4. A mandrel according to claim 2 wherein said means to urge the brake member against the brake pad is a spring.

5. A mandrel according to claim 4 wherein one end of the spring contacts a moveable abutment.

6. A mandrel according to claim 5 comprising one member which rotates with the holding means and one member which rotates with the roll on the mandrel and wherein the abutment is moved due to screw threaded engagement between said members.

7. A mandrel according to claim 2 comprising a screw threaded release means for urging the break member away from the brake pad for the purpose of resetting the brake means.

8. A mandrel according to claim 1 comprising a handle at each end, one said handle constituting the said holding means.

9. A mandrel according to claim 8 comprising two grips in each holding means.

10. A mandrel according to claim 1 which is adjustable in length.

* * * * *